US006408147B1

(12) United States Patent
Oshida

(10) Patent No.: US 6,408,147 B1
(45) Date of Patent: Jun. 18, 2002

(54) IMAGE FORMING APPARATUS AND SHEET STACKING SYSTEM

(75) Inventor: Haruhisa Oshida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/649,230

(22) Filed: Aug. 29, 2000

(30) Foreign Application Priority Data

Sep. 1, 1999 (JP) ..... 11-247875

(51) Int. Cl.[7] ..... G03G 15/00
(52) U.S. Cl. ..... 399/82; 271/207; 399/405
(58) Field of Search ..... 399/16, 81, 82, 399/83, 397, 405; 271/207, 278, 279

(56) References Cited

U.S. PATENT DOCUMENTS

| | | | | | |
|---|---|---|---|---|---|
| 4,724,462 | A | * | 2/1988 | Yamasaki et al. | 399/81 |
| 5,033,731 | A | * | 7/1991 | Looney | 271/207 X |
| 5,564,690 | A | | 10/1996 | Oshida | 271/157 |
| 5,913,093 | A | * | 6/1999 | Yamanaka et al. | 399/82 |
| 5,963,754 | A | * | 10/1999 | Itoh et al. | 399/405 X |
| 6,113,094 | A | * | 9/2000 | Horiguchi et al. | 271/207 X |
| 6,170,821 | B1 | * | 1/2001 | Kubota | 271/207 X |

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image forming part for forming an image on a sheet, a sheet discharging part for discharging a sheet having an image formed thereon by the image forming part, a sheet stacking tray for stacking thereon sheets discharged from the sheet discharging part, a first stack height detecting sensor for detecting whether a height of stack of sheets stacked on the sheet stacking tray has reached a first height, a second stack height detecting sensor In for detecting whether the height of stack of sheets stacked on the sheet stacking tray has reached a second height which is higher than the first height, and a control part for controlling the image forming apparatus by judging a state of stack of sheets on the sheet stacking tray on the basis of results of detection provided by the first stack height detecting sensor and the second stack height detecting sensor, wherein the control part judges the sheet stacking tray to be in a maximum stacked state when the second stack height detecting sensor has detected that the height of stack of sheets stacked on the sheet stacking tray has reached the second height and, after that, continues judging the sheet stacking tray to be in the maximum stacked state until the first stack height detecting sensor detects that the height of stack of sheets stacked on the sheet stacking tray has become less than the first height.

35 Claims, 12 Drawing Sheets

IMAGE FORMING APPARATUS AND SHEET STACKING SYSTEM

BACKGROUND OF THE INVENTION

1. Field of the Invention

The present invention relates to an image forming apparatus, such as a copying machine, a printer, a facsimile or the like, arranged to form an image on a sheet and to discharge the sheet onto a sheet stacking tray provided on the image forming apparatus.

2. Description of Related Art

An image forming apparatus, such as a copying machine, has heretofore been arranged to include a paper feed means for feeding a sheet of recording paper or the like, an image forming means for forming an image on the sheet supplied by the paper feed means, and a sheet discharging means for discharging, to the outside of the body of the apparatus, the sheet having an image formed thereon by the image forming means. Sheets thus discharged by the sheet discharging means are stacked one after another on a sheet stacking tray provided on the apparatus body.

In some of the image forming apparatuses of the above kind, an amount-of-stack detecting sensor for detecting an amount of stack (the height of stack) of sheets on the sheet stacking tray is provided at a sheet discharge port of the sheet discharging means. With the amount-of-stack detecting sensor arranged in this manner, the image forming apparatus can provide such control as to prevent an amount of sheets more than a predetermined amount from being stacked on the sheet stacking tray, thereby preventing jamming or fall of sheets due to excessive stacking of sheets.

It is also known that some of the conventional image forming apparatuses are provided with a plurality of sheet stacking trays (bin trays) for sorting a plurality of sheets having images formed thereon by an image forming means. The image forming apparatus having such a sorting function is arranged to control selection of use of trays for discharging the sheets.

FIG. 11 is a sectional view showing, by way of example, a conventional image forming apparatus having four sheet stacking trays vertically arranged in a four-step configuration which permits sorting sheets out. In the conventional image forming apparatus shown in FIG. 11, sheets P stacked within a paper feed cassette 201 are separated and conveyed one by one by a paper feed means 202. After an image is formed on each sheet by an image forming part 263, the image is fixed to the sheet by a fixing means 204. Paper discharge roller pairs 205*a*, 205*b*, 205*c* and 205*d* are arranged as a sheet discharging means on one side of the body of the apparatus. Sheet stacking trays 206*a*, 206*b*, 206*c* and 206*d* are arranged in positions corresponding respectively to the paper discharge roller pairs 205*a*, 205*b*, 205*c* and 205*d*.

A sheet to which an image has been fixed by the fixing means 204 is led to the paper discharge roller pair 205*a*, 205*b*, 205*c* or 205*d* selected, under the change-over control of conveying-path change-over means 207*a*, 207*b* and 207*c*, to be discharged onto the sheet stacking tray 206*a*, 206*b*, 206*c* or 206*d* corresponding to the paper discharge roller pair as selected. Amount-of-stack detecting sensors 208, 209, 210 and 211 are arranged to detect respectively the amounts of stack of sheets on the sheet stacking trays 206*a*, 206*b*, 206*c* and 206*d*.

FIG. 12 shows the arrangement of the amount-of-stack detecting sensors in the conventional image forming apparatus. Referring to FIG. 12, an amount-of-stack detecting lever 208 is arranged to detect the height of stack of sheets stacked on the first sheet stacking tray 206*a*. The amount-of-stack detecting lever 208 is swingable around a swing shaft 208*a* disposed above a nip part of the first paper discharge roller pair 205*a*. A fore end part 208*b* of the amount-of-stack detecting lever 208 is located on the side of the sheet stacking tray 206*a* across the discharge path for sheets.

A photo-sensor 208*d* detects the arrival of the amount of stack of sheets at a predetermined height when the amount-of-stack detecting lever 208 swings to a predetermined position where an actuator 208*c* which swings integrally with the amount-of-stack detecting lever 208 comes to block the optical axis of the photo-sensor 208*d*.

While the conventional image forming apparatus is in process of sorting sheets out, a control means (not shown) is arranged to cause the image forming means to suspend its image forming action on sheets when the amount-of-stack detecting sensor has detected that the sheet stacking tray has been brought into a maximum stacked state during the process of sorting the sheets.

In a case where no sheet sorting action is required, image-formed sheets are stacked, for example, only on the first sheet stacking tray 206*a*. When the amount-of-stack detecting sensor 208 has detected that the first sheet stacking tray 206*a* has been brought into a maximum stacked state, the sheet conveying path is changed, under the control of the control means, to the second paper discharge roller pair 205*b* to cause subsequent sheets to be discharged onto the second sheet stacking tray 206*b*.

In the meantime, while image-formed sheets are in process of being continuously stacked on the sheet stacking tray, there is formed a very thin layer of air between one sheet and another. This air layer gradually disappears from between the sheets due to the weight of sheets accordingly as time elapses. Therefore, a stack of sheets generally settles on the tray after the lapse of several minutes from the completion of discharge. As a result, the height of stack of sheets stacked on the sheet stacking tray decreases by an amount corresponding to the thickness of several to ten-odd sheets.

Further, in a case where a sheet is curled (warped) by the fixing action of the fixing means 204, the degree of the curl tends to decrease as the sheet heated by the fixing means 204 cools on the sheet stacking tray. In such a case, a stack of sheets on the tray also comes to settle several minutes after the discharge of sheets, and then the height of stack of sheets also comes to decrease from the height obtained immediately after the discharge of sheets.

Therefore, when the sheets are found by the first amount-of-stack detecting sensor 208 to be fully stacked on the tray while the sheets are in process of being discharged onto the first sheet stacking tray 206*a*, the control means causes use of the paper discharge port to be changed over to the second paper discharge port. The sheets then come to be discharged from the second paper discharge port onto the second sheet stacking tray 206*b*. However, while the sheets are being discharged onto the second sheet stacking tray 206*b*, the stack of sheets on the first sheet stacking tray 206*a* settles down and the height of stack of sheets stacked on the first sheet stacking tray 206*a* decrease, so that the detection of the maximum stacked state by the first amount-of-stack detecting sensor 208 comes to be canceled.

This misleads the control means to consider the first sheet stacking tray 206*a* to be vacant and causes the use of the sheet (paper) discharge port to be changed again to the first paper discharge port. As a result, the sheets cannot be correctly stacked on the trays as the paging sequence of sheets discharged on the trays is disrupted.

Further, even if, after the first sheet stacking tray 206*a* is brought into a maximum stacked state, the height of stack of sheets stacked on the first sheet stacking tray 206*a* comes to naturally decrease to cancel the maximum stacked state, the height of stack of sheets stacked on the first sheet stacking tray 206*a* is very close to the maximum stacked state. Therefore, when sheets of the next job come to be discharged onto the first sheet stacking tray 206*a* in which the maximum stacked state thereof has been canceled, several to ten-odd sheets are first stacked on the existing stack on the first sheet stacking tray 206*a*. However, after that, the use of one paper discharge port is soon changed over to another paper discharge port to cause the remaining sheets to be stacked on the second sheet stacking tray 206*b*. Then, the height of stack of sheets stacked on the first sheet stacking tray 206*a* again comes to decrease. As a result, the tray for one and the same job repeatedly shifts from the first sheet stacking tray 206*a* to the second sheet stacking tray 206*b* and vice versa. This has presented a problem.

In the case of an image forming apparatus, such as a facsimile, a network printer or the like, where sheets stay for a relatively long period of time in a state of being stacked on a sheet stacking tray, the above-stated malfunction saliently takes place to make the problem more serious.

BRIEF SUMMARY OF THE INVENTION

An object of the invention is to provide an image forming apparatus arranged to enhance the utility of the apparatus in cases where the height of stack of sheets stacked on a sheet stacking tray comes to naturally decrease. To attain the above object, in accordance with an aspect of the invention, there is provided an image forming apparatus, which comprises image forming means for forming an image on a sheet, sheet discharging means for discharging a sheet having an image formed thereon by the image forming means, a sheet stacking tray for stacking thereon sheets discharged from the sheet discharging means, first stack height detecting means for detecting whether a height of stack of sheets stacked on the sheet stacking tray has reached a first height, second stack height detecting means for detecting whether the height of stack of sheets stacked on the sheet stacking tray has reached a second height which is higher than the first height, and control means for controlling the image forming apparatus by judging a state of stack of sheets on the sheet stacking tray on the basis of results of detection provided by the first stack height detecting means and the second stack height detecting means, wherein the control means judges the sheet stacking tray to be in a maximum stacked state when the second stack height detecting means has detected that the height of stack of sheets stacked on the sheet stacking tray has reached the second height and, after that, continues judging the sheet stacking tray to be in the maximum stacked state until the first stack height detecting means detects that the height of stack of sheets stacked on the sheet stacking tray has become less than the first height.

The above and further object and features of the invention will become apparent from the following detailed description of a preferred embodiment thereof taken in conjunction with the accompanying drawings.

DETAILED DESCRIPTION OF THE INVENTION

Hereinafter, a preferred embodiment of the invention will be described in detail with reference to the drawings.

In the preferred embodiment to be described below, the invention is applied to a facsimile apparatus serving as an image forming apparatus. Here, the embodiment is described in the order of the arrangement of the whole facsimile apparatus and then the arrangement of a sheet discharge part of the facsimile apparatus.

[Arrangement of Whole Facsimile Apparatus]

Figure 1:
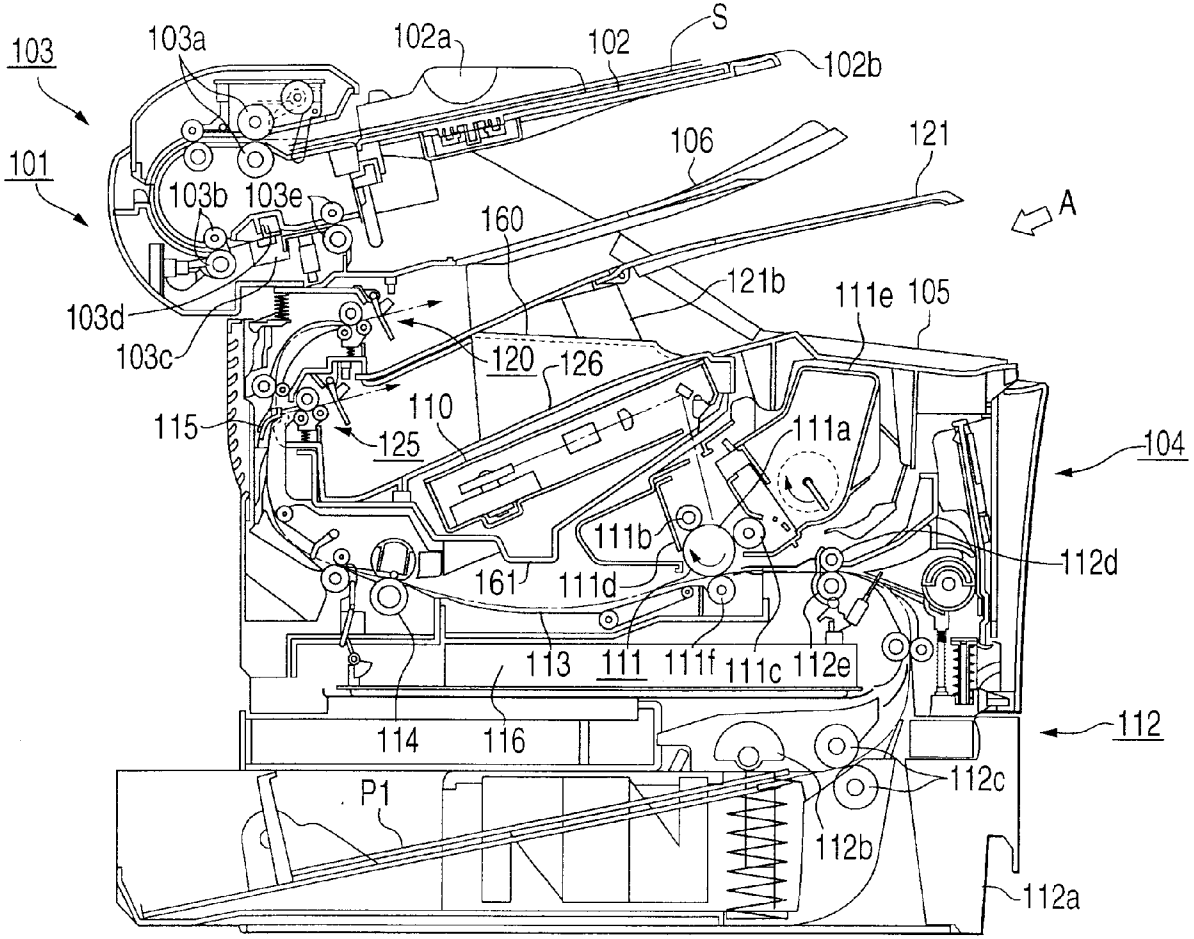
FIG. 1 is a sectional view showing the arrangement of a facsimile apparatus according to an embodiment of the invention.
Figure 2:
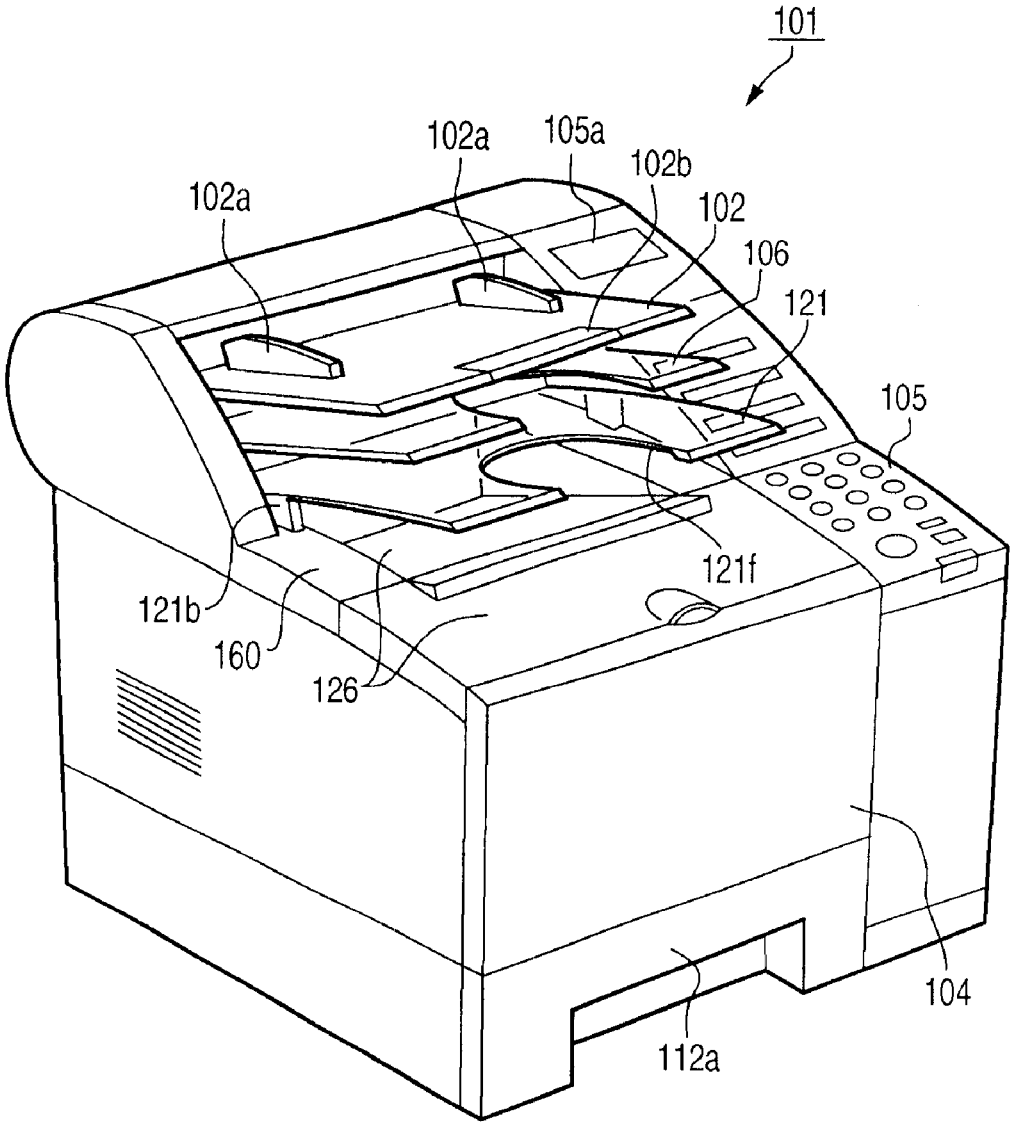
FIG. 2 is a perspective view showing the outer appearance of the facsimile apparatus shown in FIG. 1.

The arrangement of the whole facsimile apparatus is first described in outline with reference to FIGS. 1 and 2. FIG. 1 shows the facsimile apparatus in a sectional view, and FIG. 2 shows the facsimile apparatus in a perspective view.

The whole facsimile apparatus is described in outline as follows. Referring to FIGS. 1 and 2, the facsimile apparatus includes an apparatus body 101, an original loading table 102 arranged to permit a plurality of sheets of an original S to be placed thereon, an image reading part 103 arranged to read image information from the original S, a recording device body 104 which is composed of a laser beam printer, an operation part 105 which is composed of a display part 105*a*, input keys, etc., an original discharge tray 106 arranged to put thereon the original S after the image information is read, a laser scanner 110, an image forming part 111, a cassette paper feed part 112 arranged to supply a sheet or sheets to the image forming part 111, an upper sheet discharge part 120 arranged to discharge image-formed sheets thereonto, a lower sheet discharge part 125 arranged to discharge image-formed sheets thereonto, an upper sheet discharge tray 121 arranged to stack thereon the sheets discharged from the upper sheet discharge part 120, a lower sheet discharge tray 126 arranged to stack thereon the sheets discharged from the lower sheet discharge part 125, a sheet discharge flapper 115 arranged to change a sheet conveying path between a path leading to the upper sheet discharge part 120 and a path leading to the lower sheet discharge part 125, and a control means 116 for controlling the whole facsimile apparatus.

At the image reading part 103, the sheets of the original S stacked on the original loading table 102 are separated one by one with a pair of separation rollers 103*a* which are in tight contact with each other. The original S separated is conveyed to a tight-contact type image sensor 103*c* through a pair of conveying rollers 103*b* which are in tight contact with each other. An original pressing part 103*d* is arranged to bring the original S into tight contact with the tight-contact type image sensor 103*c* in such a way as to enable the image sensor 103*c* to read image information from the original S. After image reading, the original S is discharged onto the original discharge tray 106 through a pair of original discharge rollers 103*e* which are in tight contact with each other.

The original loading table 102 is provided with a slider 102*a* which is slidable in a direction orthogonally intersecting a direction in which the original S is conveyed (in the direction of width of the original S). The slider 102*a* is thus arranged to align the two sides of the sheets of the original S stacked on the original loading table 102. In a case where the original S is in a long shape, an extension original tray 102*b* is expanded to prevent the rear end of the original S from drooping by coming off the original loading table 102.

The tight-contact type image sensor 103*c* is arranged to illuminate the image information surface of the original S with light from an LED array employed as a light source and to read the image information by imaging, on an image sensor, reflection light of the image information surface resulting from the illumination.

The cassette paper feed part 112 is disposed at a lower part of the apparatus body 101. Sheets P1 which are stacked on a paper feed cassette 112*a* are separated and conveyed one by one jointly by a paper feed roller 112*b* and a pair of separation rollers 112*c*.

The sheet P1 singly separated comes to a pair of registration rollers 112*d*, at which any oblique movement of the sheet P1 is corrected. After that, the fore end position of the sheet P1 is detected by a TOP sensor 112*e*. Then, the timing of image forming is controlled in such a way as to have the fore end position of the sheet P1 coincide with the fore end of a toner image formed on a photosensitive member drum 111*a*. Under this control, the sheet P1 is conveyed to a part between the photosensitive member drum 111*a* and a transfer charger 111*f*.

At the recording device body 104, image light is applied to the photosensitive member drum 111*a* of the image forming part 111 from the laser scanner 110 on the basis of an image signal outputted from the control means 116, to form an electrostatic latent image on the surface of the photosensitive member drum 111*a*. The electrostatic latent image is converted into a toner image by a developing means 111*c*. The toner image is then transferred to the sheet P1 supplied from the cassette paper feed part 112 to the image forming part 111.

The photosensitive member drum 111*a* is incorporated into a process cartridge 111*e* together with a charging means 111*b*, the developing means 111*c* and a cleaning means 111*d*. The process cartridge 111*e* is detachably mounted on the apparatus body 101.

The transfer charger 111*f* is disposed below the photosensitive member drum 111*a* of the image forming part 111. A thermal fixing device 114 is disposed at a sheet conveying path on the downstream side of the photosensitive member drum 111*a*.

Figure 3:
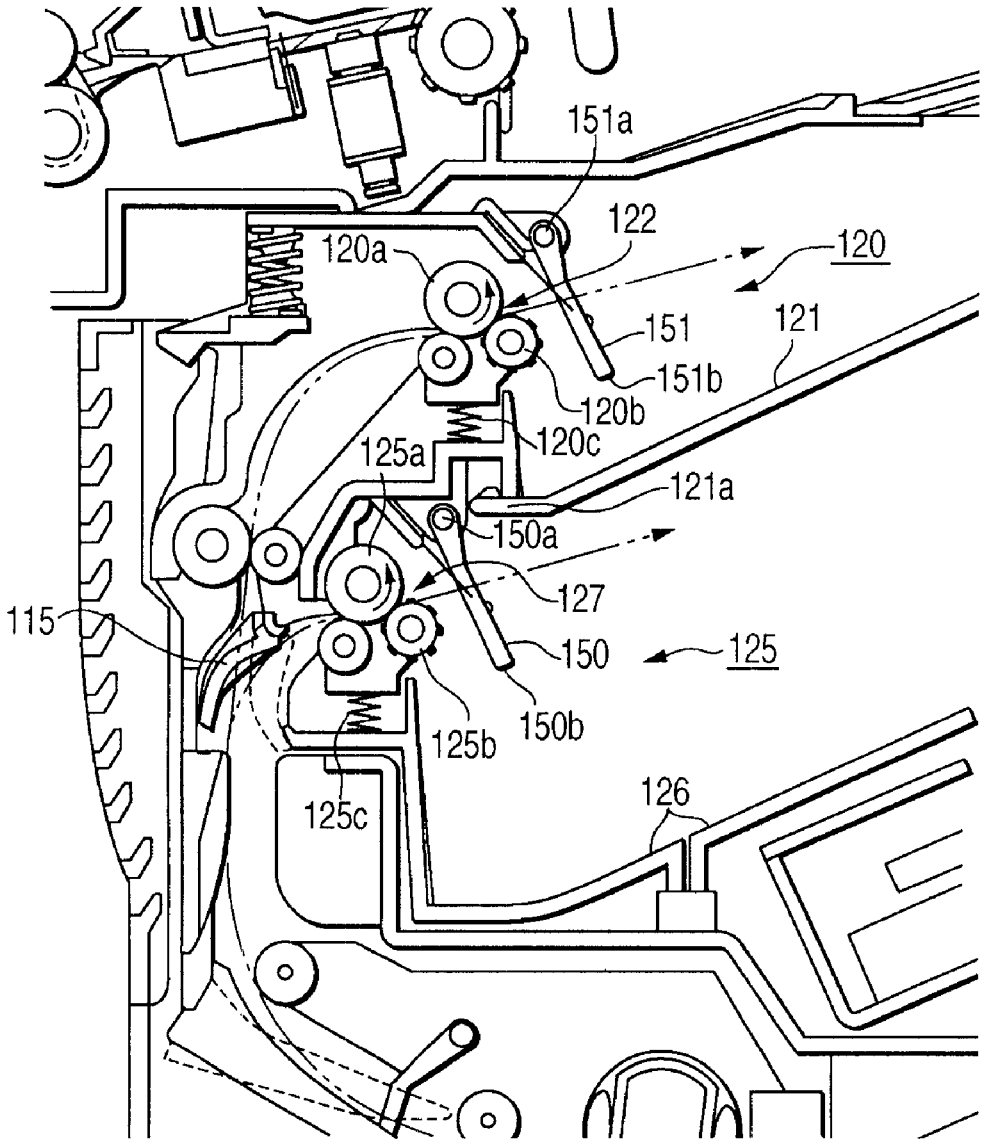
FIG. 3 is a sectional view showing the arrangement of a sheet discharge part of the facsimile apparatus shown in FIG. 1.

After the toner image formed on the surface of the photosensitive member drum 111*a* is transferred to the sheet P1 by the transfer charger 111*f*, the sheet P1 is conveyed by a recording sheet conveying part 113. Then, the toner image is fixed to the sheet P1 by the thermal fixing device 114. The path of conveying the sheet P1 is switched, by the sheet discharge flapper 115 disposed on the downstream side of the thermal fixing device 114, between a sheet path leading to an upper sheet discharge port 122 and another sheet path leading to a lower sheet discharge port 127, as shown in FIG. 3.

The sheet P1 is thus selectively discharged, through the change-over action of the sheet discharge flapper 115, either onto the upper sheet discharge tray 121 disposed at an upper part of the sheet discharge part or the lower sheet discharge tray 126 disposed below the upper sheet discharge tray 121. The sheet discharge flapper 115 is arranged to perform the change-over action by means of a solenoid (not shown) which is driven by a control signal sent from the control means 116.

The control means 116 is arranged to control the whole facsimile apparatus by sending control signals to applicable parts of the facsimile apparatus. Further, as will be described later, the control means 116 makes a check for the states of stack of sheets on the upper sheet discharge tray 121 and the lower sheet discharge tray 126 and performs control on the basis of the result of the check.

[Arrangement of Sheet Discharge Part]

The arrangement of the sheet discharge part is next described with reference to FIG. 1 and FIG. 3 which shows the sheet discharge part in detail.

The upper sheet discharge part 120 in the present embodiment includes an upper sheet discharge roller 120*a*, an upper sheet discharge driven roller 120*b* and an upper-sheet-discharge-driven-roller pressing member 120*c*. The upper sheet discharge tray 121 is disposed below the upper sheet discharge part 120.

The lower sheet discharge part 125 includes a lower sheet discharge roller 125*a*, a lower sheet discharge driven roller 125*b* and a lower-sheet-discharge-driven-roller pressing member 125*c*. The lower sheet discharge tray 126 is disposed below the lower sheet discharge part 125.

In forming images by the recording device body 104, the upper sheet discharge roller 120*a* or the lower sheet discharge roller 125*a* receives a driving force from a driving motor (not shown) which is arranged to be driven according to the control signal sent from the control means 116. Upon receipt of the driving force from the driving motor, the upper sheet discharge roller 120*a* or the lower sheet discharge roller 125*a* rotates counterclockwise in the direction of an arrow shown in FIG. 3, to discharge the sheet either onto the upper sheet discharge tray 121 or onto the lower sheet discharge tray 126.

The lower sheet discharge tray 126 is formed integrally with a cover member 160 which is arranged to cover the upper part of the recording device body 104.

On the other hand, the upper sheet discharge tray 121 is made of a resin in a thin-plate-like shape. On its base end side, the upper sheet discharge tray 121 is supported by the apparatus body 101 at an end part 121*a* on the upstream side in the direction of discharging the sheet. On its fore end side, the upper sheet discharge tray 121 extends into a space above the lower sheet discharge tray 126.

The upper sheet discharge tray 121 is provided with a leg part 121*b*. The leg part 121*b* is arranged at about a middle part, in the sheet discharging direction, of the upper sheet discharge tray 121 to support the upper sheet discharge tray 121 by abutting on the cover member 160. Further, as shown in FIG. 2, the fore end side of the upper sheet discharge tray 121 is provided with a cutout part 121*f* of an approximately semicircular shape, which is arranged to enable the user to easily take out sheets of small size.

A lower amount-of-stack detecting lever 150 is arranged, as shown in FIG. 3, to detect the height of stack of sheets stacked on the lower sheet discharge tray 126. The lower amount-of-stack detecting lever 150 is swingable on a swing shaft 150*a* disposed above the lower sheet discharge port 127. The fore end part 150*b* of the lower amount-of-stack detecting lever 150 is located lower than the sheet discharge path.

An upper amount-of-stack detecting lever 151 is arranged, as shown in FIG. 3, to detect the height of stack of sheets stacked on the upper sheet discharge tray 121. Similarly to the lower amount-of-stack detecting lever 150, the upper amount-of-stack detecting lever 151 is swingable on a swing shaft 151*a* disposed above the upper sheet discharge port 122. The fore end part 151*b* of the upper amount-of-stack detecting lever 151 is located lower that the sheet discharge path.

Figure 4:
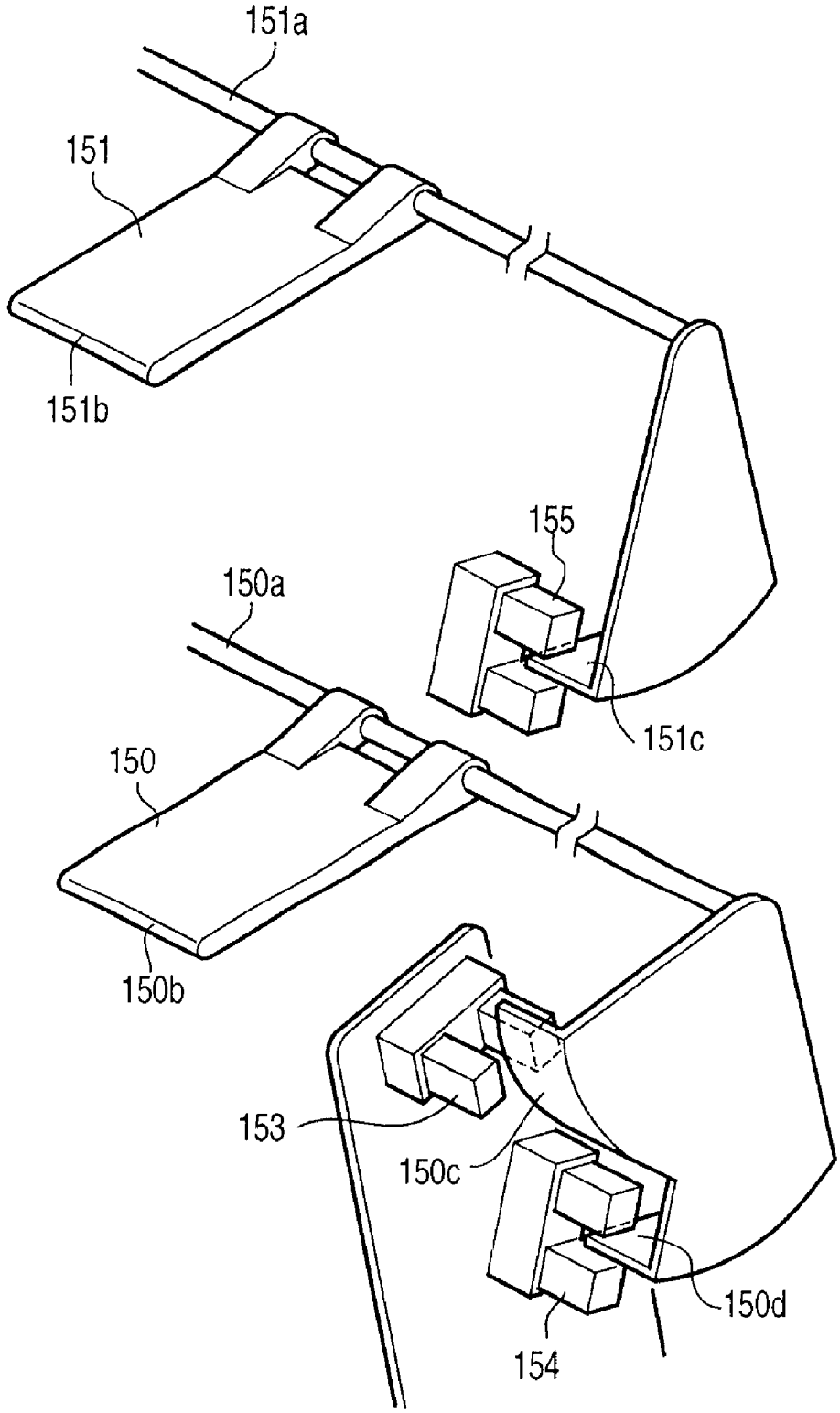
FIG. 4 is a perspective view showing the arrangement of a stack height detecting means for detecting the amount of stack of sheets on each of sheet discharge trays of the sheet discharge part shown in FIG. 3.

Referring to FIGS. 3 and 4, the arrangement and actions of the lower amount-of-stack detecting lever 150 and the upper amount-of-stack detecting lever 151 are described below. A first actuator 150*c* and a second actuator 150*d* are integrally provided at one end part of the swing shaft 150*a* of the lower amount-of-stack detecting lever 150. There are provided a first photo-sensor 153 and a second photo-sensor 154.

When the lower amount-of-stack detecting lever 150 swings to a first predetermined position, the first actuator 150*c* comes to block the optical axis of the first photo-sensor 153. The second actuator 150*d* blocks the optical axis of the second photo-sensor 154 when the swing of the lower amount-of-stack detecting lever 150 comes to a second predetermined position.

A third actuator 151*c* is integrally provided at one end part of the swing shaft 151*a* of the upper amount-of-stack detecting lever 151. There is provided a third photo-sensor 155. The third actuator 151*c* is arranged to block the optical axis of the third photo-sensor 155 when the swing of the upper amount-of-stack detecting lever 151 comes to a third predetermined position.

Referring to FIGS. 5(A) and 5(B) to FIGS. 10(A) and 10(B), the actions of the amount-of-stack detecting levers 150 and 151 to be performed while sheets are in process of being stacked are shown in FIGS. 5(A), 6(A), 7(A), 8(A), 9(A) and 10(A), and the relation of the actuators to the photo-sensors then varies as shown in FIGS. 5(B), 6(B), 7(B), 8(B), 9(B) and 10(B) while the sheets are in process of being stacked.

Figure 5A:
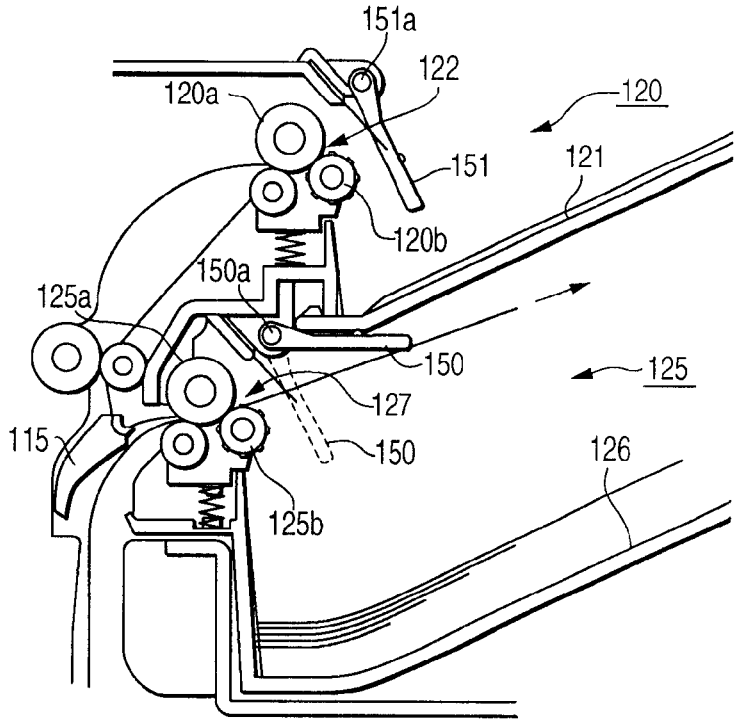
FIGS. 5(A) and 5(B) are diagrams for explaining the action of amount-of-stack detecting levers performed while sheets are in process of being stacked at the sheet discharge part and a relation obtained at that time between each actuator and the associated photo-sensor.
Figure 5B:
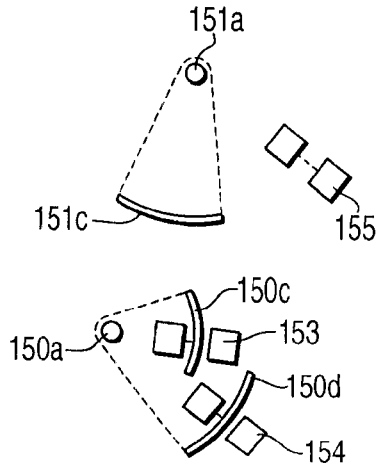

With a sheet discharged from the lower sheet discharge port 127, the lower amount-of-stack detecting lever 150 is pushed upward by the sheet to swing counterclockwise as shown in FIG. 5(A) while the sheet is passing the lower sheet discharge part 125. Then, as shown in FIG. 5(B), the first actuator 150*c* blocks the optical axis of the first photo-sensor 153 and the second actuator 150*d* blocks the optical axis of the second photo-sensor 154.

When the sheet is discharged from the lower sheet discharge port 127 to fall on the lower sheet discharge tray 126, the lower amount-of-stack detecting lever 150 is swung clockwise by its own weight to a standby position as indicated by a broken line in FIG. 5(A). With the lower amount-of-stack detecting lever 150 moved to take its standby position, the optical axes of both the first photo-sensor 153 and the second photo-sensor 154 are released from their blocked states.

If each of the first photo-sensor 153 and the second photo-sensor 154 is assumed to be in an off-state when it is in a state of having its optical axis blocked and to be in an on-state when its optical axis is in a state of being released from the blocked state, the output signals of the first photo-sensor 153 and the second photo-sensor 154 repeatedly turn on and off while the sheets are being continuously discharged from the lower sheet discharge port 127.

Figure 6A:
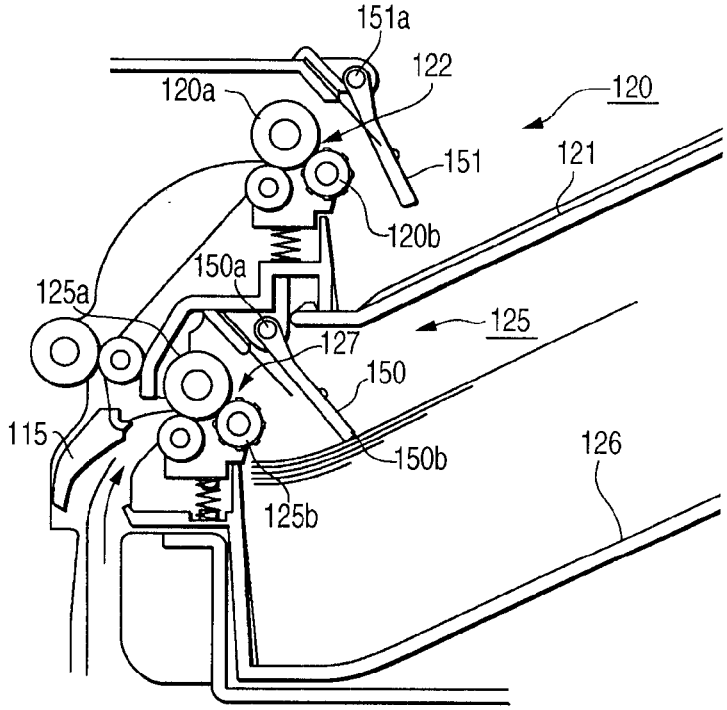
FIGS. 6(A) and 6(B) are diagrams for explaining the action of the amount-of-stack detecting levers performed when the sheets are stacked to a certain amount on a lower sheet discharge tray at the sheet discharge part and a relation obtained at that time between each actuator and the associated photo-sensor.
Figure 6B:
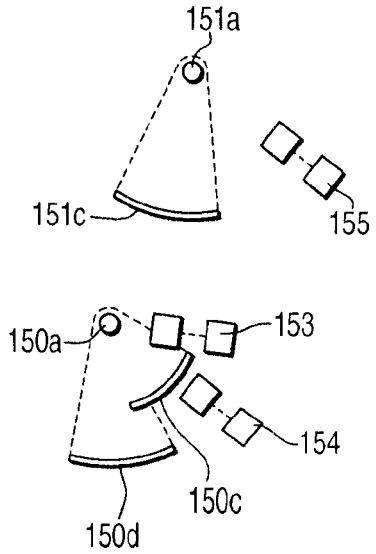

When the sheets are stacked on the lower sheet discharge tray 126 to a certain amount, the fore end part 150*b* of the lower amount-of-stack detecting lever 150, which has been swung clockwise by its own weight, comes into contact with the sheets stacked on the lower sheet discharge tray 126, as shown in FIG. 6(A). After that, the standby position of the lower amount-of-stack detecting lever 150 gradually moves upward while swinging counterclockwise accordingly as the amount of stack of the sheets increases.

Figure 7A:
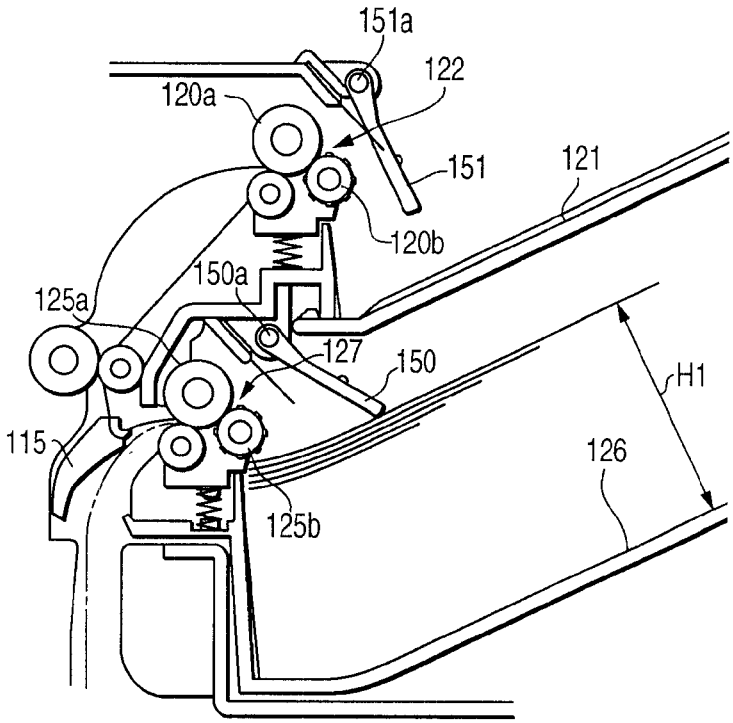
FIGS. 7(A) and 7(B) are diagrams for explaining the action of the amount-of-stack detecting levers performed when the sheets are stacked to an amount close to a maximum amount on the lower sheet discharge tray at the sheet discharge part and a relation obtained at that time between each actuator and the associated photo-sensor.
Figure 7B:
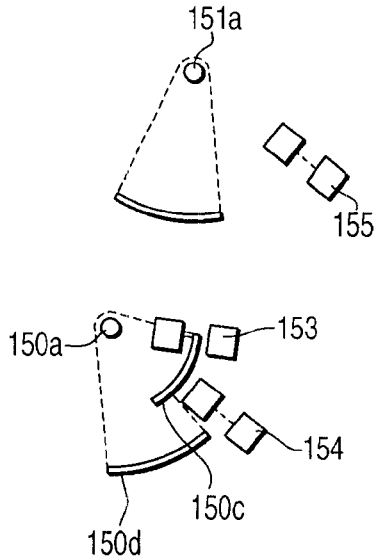

With the stack of sheets on the lower sheet discharge tray 126 coming near to a maximum stacked state, when the height of stack of sheets reaches a stack height H1 as shown in FIG. 7(A), the standby position of the lower amount-of-stack detecting lever 150 further rises as shown in FIG. 7(A). Then, as shown in FIG. 7(B), the first actuator 150*c* comes to block the optical axis of the first photo-sensor 153.

Therefore, the output signal of the first photo-sensor 153 then comes to be constantly in an off-state irrespectively of the discharge action on the sheets.

On the other hand, since the second actuator 150*d* is not blocking the optical axis of the second photo-sensor 154, the output signal of the second photo-sensor 154 repeatedly turns on and off while the sheets are in process of being discharged.

With the output signal of the first photo-sensor 153 having come to be constantly in its off-state, the control means 116 judges the stack of sheets on the lower sheet discharge tray 126 to be close to a maximum stacked state. The control means 115 then controls and causes the display part 105*a* to make a display (near-end display) indicating that the stack of sheets on the lower sheet discharge tray 126 is close to the maximum stacked state. At this time, the control means 116 does not cause the change-over of the sheet discharge port (sheet conveying path) as yet.

Figure 8A:
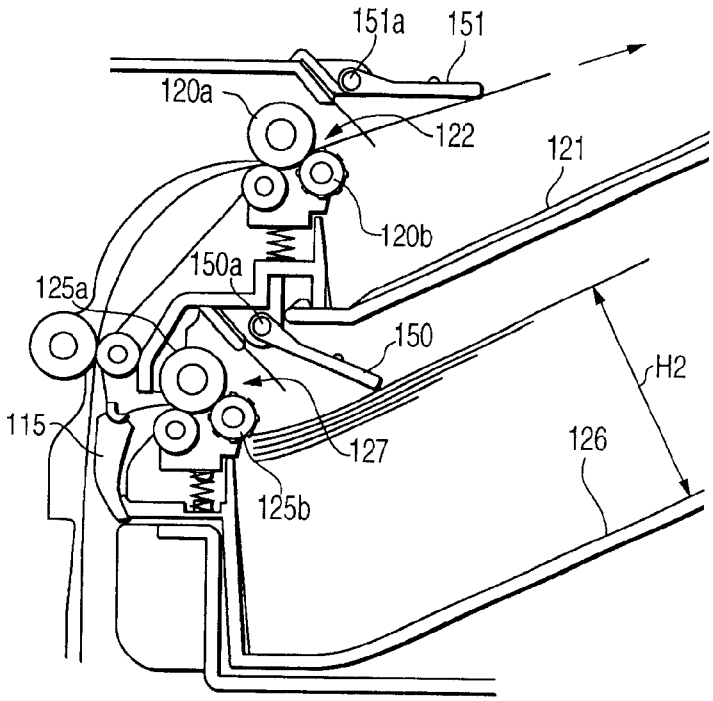
FIGS. 8(A) and 8(B) are diagrams for explaining the action of the amount-of-stack detecting levers performed when the sheets are stacked to the maximum amount on the lower sheet discharge tray at the sheet discharge part and a relation obtained at that time between each actuator and the associated photo-sensor.
Figure 8B:
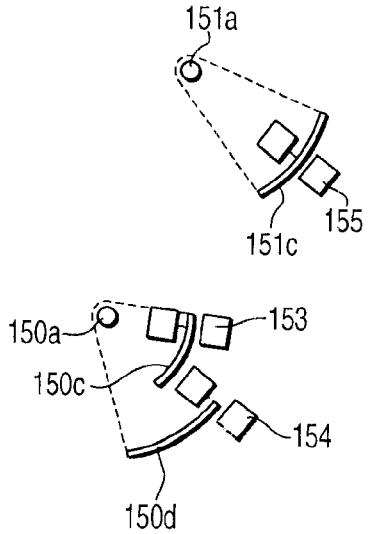

With the sheets stacked further, when the height of stack of sheets reaches a second stack height H2 which is higher than the first stack height H1, the standby position of the lower amount-of-stack detecting lever 150 rises further as shown in FIG. 8(A). Then, as shown in FIG. 8(B), there is obtained a state in which the first actuator 150*c* and the second actuator 150*d* are blocking respectively the optical axis of the first photo-sensor 153 and that of the second photo-sensor 154.

Therefore, the output signal of the first photo-sensor 153 and that of the second photo-sensor 154 come to be constantly in their off-states irrespective of the discharge action on the sheets. In the case of the present embodiment, a difference between the first stack height H1 and the second stack height H2 is set to 2.8 mm.

The control means 116 judges, through the change of the output signal of second photo-sensor 154, that the stack of sheets on the lower sheet discharge tray 126 has reached a maximum stacked state. Then, the control means 116 controls and causes the display part 105*a* to turn off the display indicating that the stack of sheets on the lower sheet discharge tray 126 is close to the maximum stacked state, and controls and causes the display part 105*a* to make a display indicating that the stack of sheets on the lower sheet discharge tray 126 has reached the maximum stacked state. At the same time, the control means 116 controls the solenoid to cause the sheet discharge flapper 115 to change the use of the sheet discharge port from the lower sheet discharge port 127 over to the upper sheet discharge port 122.

The change-over action of the sheet discharge flapper 115 causes sheets to be discharged and stacked on the upper sheet discharge tray 121, as shown in FIG. 8(A). Then, similarly to the case of the lower sheet discharge part 125, the upper amount-of-stack detecting lever 151 for the upper sheet discharge part 120 repeatedly acts to swing counter-clockwise and then to come back to a standby state while the sheets are in process of being discharged from the upper sheet discharge part 120. Therefore, the output signal of the third photo-sensor 155 repeatedly turns on and off, as shown in FIG. 8(B).

Figure 9A:
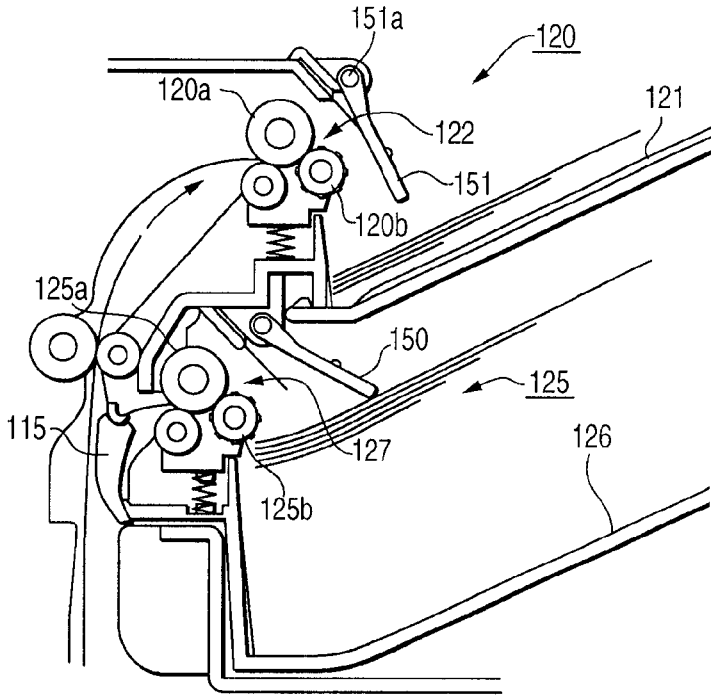
FIGS. 9(A) and 9(B) are diagrams for explaining the action of the amount-of-stack detecting levers performed when the height of stack of sheets naturally decreases after the sheets are stacked to the maximum amount (height) on the lower sheet discharge tray at the sheet discharge part and a relation obtained at that time between each actuator and the associated photo-sensor.
Figure 9B:
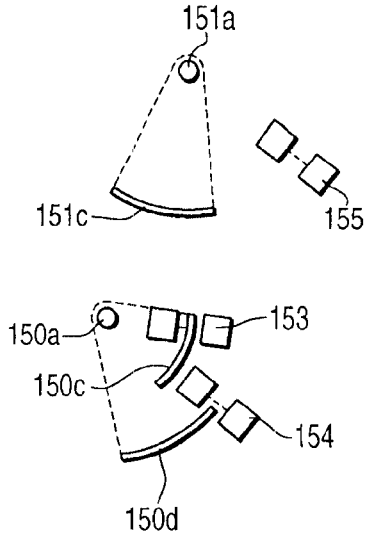

In a short time after the use of the sheet discharge port is changed over to the upper sheet discharge port 122, air existing between one sheet and another stacked on the lower sheet discharge tray 126 comes to disappear and, in addition to that, a curled state of sheets decreases, so that the height of the stack of sheets decreases to a slight degree, as shown in FIG. 9(A).

As a result, the optical axis of the second photo-sensor 154 becomes unblocked. The output signal of the second photo-sensor 154 then comes to be constantly in its on-state. On the other hand, the optical axis of the first photo-sensor 153 remains in a state of being blocked by the first actuator 150*c*. The output signal of the first photo-sensor 153 thus continues to be in its off-state. The positional relation of the decrease in height of the stack of sheets to the photo-sensors will be described later.

Under this condition, the control means 116 judges that the stack of sheets on the lower sheet discharge tray 126 remains in the maximum stacked state, as long as the output signal of the first photo-sensor 153 is in its off-state even if the output signal of the second photo-sensor 154 is in its on-state. The use of the sheet discharge port is thus not changed from the upper sheet discharge port 122 over to the lower sheet discharge port 127. Further, the display part 105*a* is controlled not to put out the display indicating that the stack of sheets on the lower sheet discharge tray 126 has reached the maximum stacked state.

Figure 10A:
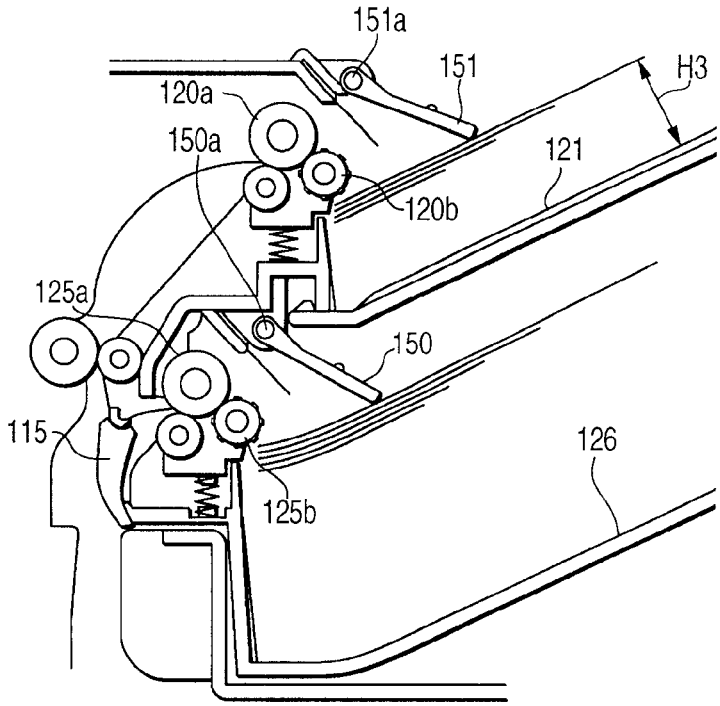
FIGS. 10(A) and 10(B) are diagrams for explaining the action of the amount-of-stack detecting levers performed when the sheets are stacked to a maximum amount (height) on an upper sheet discharge tray at the sheet discharge part and a relation obtained at that time between each actuator and the associated photo-sensor.
Figure 10B:
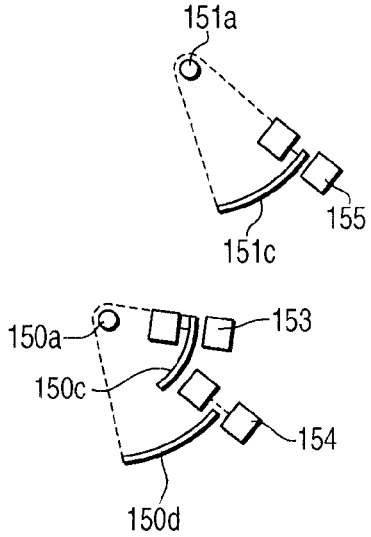
Figure 11:
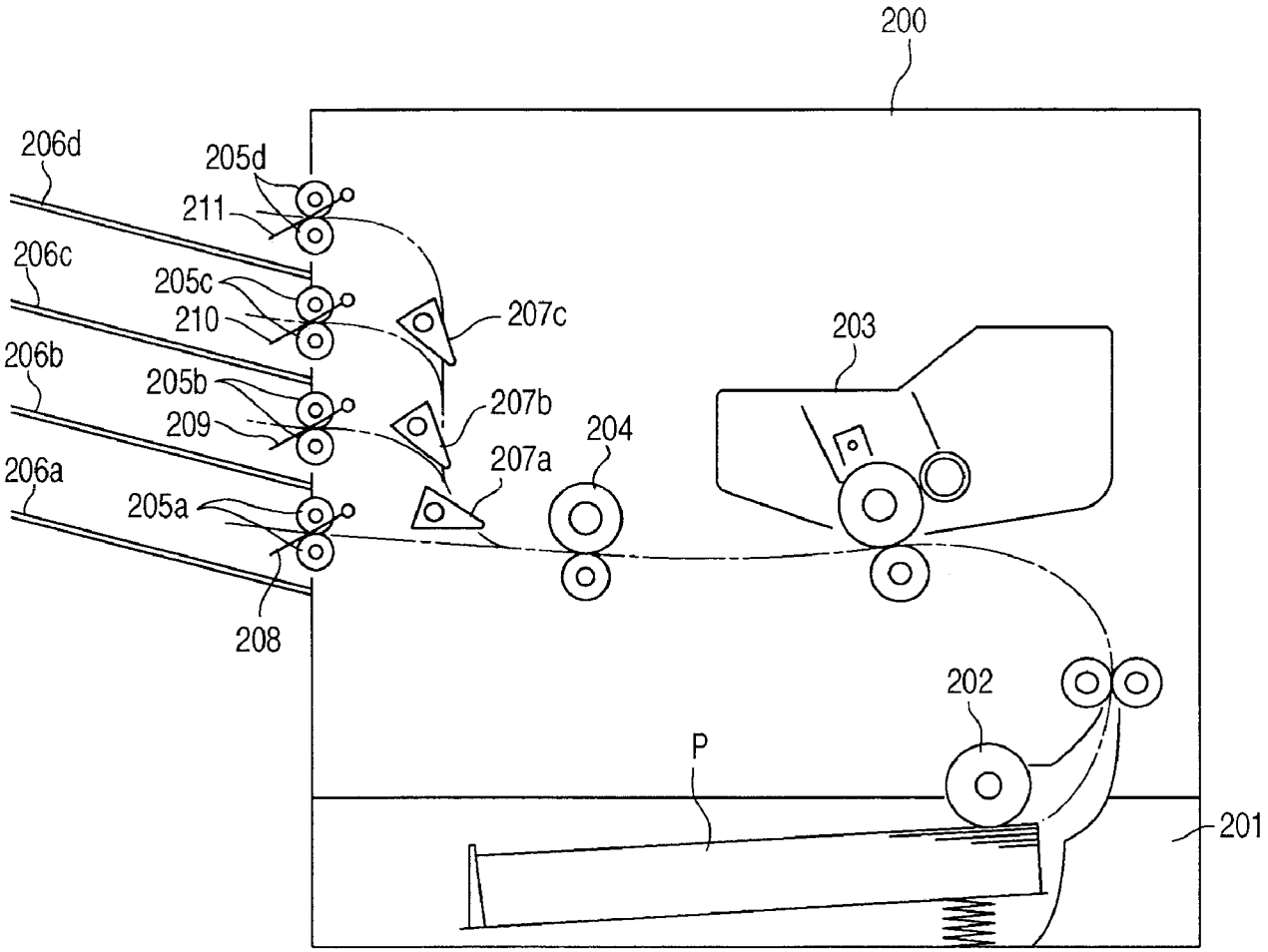
FIG. 11 is a sectional view showing the arrangement of a conventional image forming apparatus.
Figure 12:
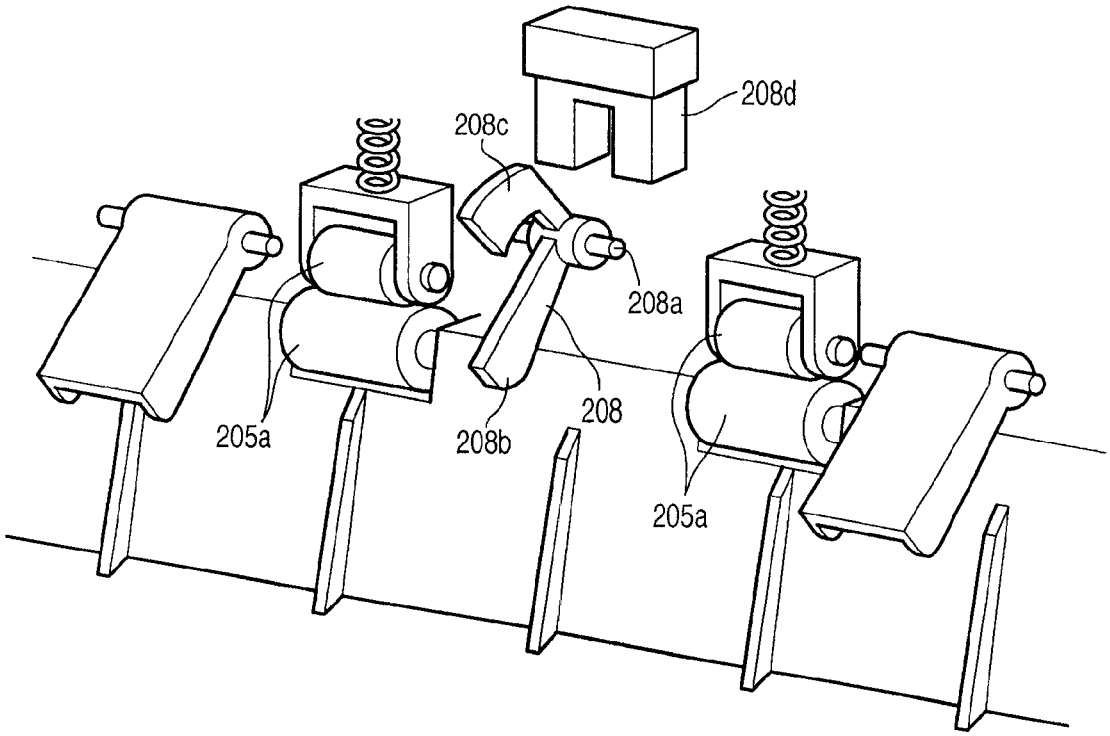
FIG. 12 is a perspective view showing the outer appearance of essential parts of a sheet discharge port for explaining an amount-of-stack detecting sensor in the conventional image forming apparatus.

Further, with the sheets stacked further on the upper sheet discharge tray 121, when the height of the stack of sheets reaches a third stack height H3, the standby position of the upper amount-of-stack detecting lever 151 rises as shown in FIG. 10(A). Then, there is obtained a state in which the third actuator 151*c* blocks the optical axis of the third photo-sensor 155, as shown in FIG. 10(B).

Therefore, the output signal of the third photo-sensor 155 comes to be constantly in its off-state despite of the sheet discharge action. The change of the state of the output signal of the third photo-sensor 155 causes the control means 116 to judge that the stack of sheets on the upper sheet discharge tray 121 has reached a maximum stacked state. Then, the control means 116 controls and causes the display part 105*a* to make a display indicating that the stack of sheets on the upper sheet discharge tray 121 has reached a maximum stacked state.

At this time, if the stack of sheets on the lower sheet discharge tray 126 is also in a maximum stacked state, i.e., if the output signal of the first photo-sensor 153 is in its off-state, the control means 116 controls and causes the recording device body 104 to suspend the process of image forming. The control means 116 then performs control to store in a memory (not shown) image information which has been expected to be formed into an image on a sheet by the recording device body 104.

In a case where the lower amount-of-stack detecting lever 150 comes to swing, for example, when the sheets are removed from the lower sheet discharge tray 126 by the user with the stack of sheets both on the lower sheet discharge tray 126 and the upper sheet discharge tray 121 in the maximum stacked state, to turn on both the output signals of the first photo-sensor 153 and the second photo-sensor 154, the control means 116 judges, from the change in the states of the output signals of the photo-sensors 153 and 154, the lower sheet discharge tray 126 to have become usable again for stacking sheets thereon. The control means 116 then controls the display part 105*a* to put out the display indicating that the stack of sheets on the lower sheet discharge tray 126 has reached a maximum stacked state and, at the same time, sends a control signal to the solenoid to operate the sheet discharge flapper 115 to change the use of the upper sheet discharge port 122 over to the use of the lower sheet discharge port 127. Then, a state of inhibiting discharge of sheets from the lower sheet discharge port 127 is canceled.

Further, the upper amount-of-stack detecting lever 151 comes to swing by its own weight to a standby position when the sheets are removed from the upper sheet discharge tray 121 by the user with the stack of sheets both on the lower sheet discharge tray 126 and the upper sheet discharge tray 121 in the maximum stacked state. Then, the output signal of the third photo-sensor 155 turns on. The control means 116 judges, from the change in the state of the output signal of the third photo-sensor 155, the upper sheet discharge tray 121 to have become usable again for stacking sheets thereon. The control means 116 then controls the display part 105*a* to put out the display indicating that the stack of sheets on the upper sheet discharge tray 121 has reached a maximum stacked state and, at the same time, cancels a controlled state of inhibiting discharge of sheets from the upper sheet discharge port 122.

After canceling the sheet discharge inhibiting control, the control means 116 controls the recording device body 104 to form on a sheet an image of the image information stored in the memory. The control means 116 sends control signals to the driving motor and the solenoid to cause the image-formed sheet to be discharged onto the sheet discharge tray 126 or 121 for which the sheet discharge inhibiting control is canceled.

With the facsimile apparatus arranged and controlled according to the present embodiment as described above, the use of the sheet discharge port is not changed over to the lower sheet discharge port 127, even if the height of a stack of sheets on the lower sheet discharge tray 126 naturally decreases due to the effluence of air from between one sheet and another or a change of a curled state of the sheets stacked, as long as the height of the stack of sheets does not become less than the stack height H1.

Therefore, with a sheet discharge tray found to be in a state of having sheets stacked to the maximum amount thereon, discharge of sheets onto this tray is allowed only after the sheets stacked are removed by the user from the sheet discharge tray.

Further, with sheets stacked on the lower sheet discharge tray 126 to the maximum amount and the sheet discharge destination changed over to the upper sheet discharge tray 121, when the sheets stacked on the lower sheet discharge tray 126 are removed by the user to cancel the maximum stacked state of the lower sheet discharge tray 126 while sheets have not been stacked to the maximum amount as yet on the upper sheet discharge tray 121, sheets are continuously discharged onto the upper sheet discharge tray 121 either until the stack of sheets on the upper sheet discharge tray 121 reaches the maximum stacked state or until the current job of discharging sheets ends. Therefore, the sheet stacking order of one job can be carried out without being disturbed.

The height of stack of sheets, which naturally decreases due to the escape of air from between sheets or a decrease in the curled state of sheets, varies with the amount of stack of sheets or the environment. However, according to the result of tests, the arrangement of setting a difference between the first stack height H1 and the second stack height H2 to about 2 mm enables an image forming apparatus having an ordinary sheet stacking capacity for each sheet discharge tray (between 50 and 500 sheets in the case of ordinary paper) to adequately operate.

In the case of the present embodiment, the reliability of the apparatus is enhanced by setting the difference between the first stack height Hi and the second stack height H2 to 2.8 mm as mentioned above. This advantage is attained by arranging the first actuator 150*c* and the first photo-sensor 153 in such a shape and at such a position that effectively prevents the natural decrease in height of the stack of sheets from causing the output signal of the first photo-sensor 153 to turn on.

While the sheet stacking (discharge) trays in the present embodiment are provided with a means for detecting a maximum stacked state of the stack of sheets, the trays are not provided with any means for detecting the presence or absence of sheets discharged onto the trays.

In a case where each tray is provided with such means for detecting the present or absence of discharged sheets, the present embodiment can be arranged as follows. With both the lower sheet discharge tray 126 and the upper sheet discharge tray 121 having reached a maximum stacked state, if the user only partly removes the sheets by such an amount that cancels the maximum stacked state of the stack of sheets on the lower sheet discharge tray 126 (i.e., that causes the output signal of the first photo-sensor 153 to turn on), with some of the sheets still left on the lower sheet discharge tray 126, the control means does not cancel the inhibiting control that inhibits sheets from being discharged onto the lower sheet discharge tray 126.

The arrangement of the embodiment described above may be changed to arrange the amount-of-stack detecting lever to extend to reach the sheet discharge tray and to detect the presence or absence of the sheets in addition to detecting the amount of stack of sheets on the sheet discharge tray.

In the embodiment described above, two detection means are arranged to detect the heights H1 and H2 of the stack of sheets on the lower sheet discharge tray 126. The two height detecting means, however, may be replaced with one detecting means arranged to output detection signals with respect to two threshold values corresponding to the heights H1 and H2 of the stack of sheets.

While the two sheet discharge parts including the upper and lower sheet discharge parts are arranged in the case of the embodiment described above, in accordance with the invention, the number of the sheet discharge parts is of course not limited to two.

While the present embodiment is arranged to discharge sheets first onto the lower sheet discharge tray 126, the invention is not limited to any specific sequence of use of a plurality of sheet discharge trays.

In the embodiment described above, the recording device body 104 is provided with the control means 116 and the display means 105*a*. However, this arrangement may be changed. For example, the recording device body 104 may be arranged to exclude the control means 116 and the display means 105*a*, as in the case of a network printer. In such a case, the control means 116 and the display means 105*a* described in the foregoing are arranged at a terminal, such as a personal computer, connected to the recording device body 104 through a network, and an image forming system is formed to control the recording device body 104 with the terminal such as a personal computer.

Further, the invention is not limited to the control over an image forming apparatus having an image forming means, but may be applied to a sheet stacking apparatus having such a construction as to stack sheets thereon, for example, a sheet stacking tray of a sheet processing apparatus for applying predetermined processing to sheets.

As apparent from the foregoing description, in accordance with the invention, an image forming apparatus can be arranged to be capable of solving the problem caused by a natural decrease of the height of stack of sheets on a sheet stacking tray.

What is claimed is:

1. An image forming apparatus, comprising:

image forming means for forming an image on a sheet;

sheet discharging means for discharging a sheet having an image formed thereon by said image forming means;

a sheet stacking tray for stacking thereon sheets discharged from said sheet discharging means;

first stack height detecting means for detecting whether a height of a stack of sheets stacked on said sheet stacking tray has reached a first height;

second stack height detecting means for detecting whether a height of stack of the sheets stacked on said sheet stacking tray has reached a second height which is higher than the first height; and control means for controlling said image forming apparatus by judging a state of stack of sheets on said sheet stacking tray on the basis of results of detection provided by said first stack height detecting means and said second stack height detecting means, wherein said control means judges said sheet stacking tray to be in a maximum stacked state when said second stack height detecting means has detected that the height of stack of sheets stacked on said sheet stacking tray has reached the second height and, after that, continues judging said sheet stacking tray to be in the maximum stacked state until said first stack height detecting means detects that the height of stack of sheets stacked on said sheet stacking tray has become less than the first height.

2. An image forming apparatus according to claim 1, wherein said control means performs control to stop sheets from being discharged onto said sheet stacking tray, when the height of the stack of sheets stacked on said sheet stacking tray has reached the second height, and, after that, to continue stopping sheets from being discharged onto said sheet stacking tray, until the height of the stack of sheets stacked on said sheet stacking tray has become less than the first height.

3. An image forming apparatus according to claim 1, further comprising memory means for storing image information to be formed on a sheet by said image forming means, wherein said control means performs control to store, in said memory means, image information to be subsequently formed, when the height of the stack of sheets stacked on said sheet stacking tray has reached the second height, and, after that, to cause the image information stored in said memory means to be formed on a sheet and to begin discharging sheets onto said sheet stacking tray, when the height of the stack of sheets stacked on said sheet stacking tray has become less than the first height.

4. An image forming apparatus according to claim 1, further comprising display means for displaying the state of the stack of sheets on said sheet stacking tray on the basis of results of detections provided by said first stack height detecting means and said second stack height detecting means, wherein said control means performs control to cause said display means to make a display indicating that said sheet stacking tray is in the maximum stacked state, by judging said sheet stacking tray to be in the maximum stacked state when said second stack height detecting means has detected that the height of the stack of sheets stacked on said sheet stacking tray has reached the second height, and, after that, to cause said display means to continue making the display indicating that said sheet stacking tray is in the maximum stacked state, until said first stack height detecting means detects that the height of the stack of sheets stacked on said sheet stacking tray has become less than the first height.

5. An image forming apparatus according to claim 4, wherein said control means causes said display means to make a display indicating that said sheet stacking tray is close to the maximum stacked state, when the height of the stack of sheets stacked on said sheet stacking tray has reached the first height, and, after that, causes said display means to make the display indicating that said sheet stacking tray is in the maximum stacked state, when the height of the stack of sheets stacked on said sheet stacking tray has reached the second height.

6. An image forming apparatus according to claim 1, wherein a difference between the first height and the second height in the height of the stack of sheets stacked on said sheet stacking tray is not less than 2 mm.

7. An image forming apparatus according to claim 1, further comprising presence-or-absence detecting means for detecting presence or absence of sheets stacked on said sheet stacking tray, wherein said control means performs control to stop sheets from being discharged onto said sheet stacking tray, when the height of stack of sheets stacked on said sheet stacking tray has reached the second height, and, after that, to continue stopping sheets from being discharged onto said sheet stacking tray, until disappearance of sheets from said sheet stacking tray is detected by said presence-or-absence detecting means.

8. An image forming apparatus, comprising:

image forming means for forming an image on a sheet;

first sheet discharging means and second sheet discharging means each for discharging a sheet having an image formed thereon by said image forming means;

a first sheet stacking tray for stacking thereon sheets discharged from said first sheet discharging means;

a second sheet stacking tray for stacking thereon sheets discharged from said second sheet discharging means;

first stack height detecting means for detecting whether a height of a stack of sheets stacked on said first sheet stacking tray has reached a first height;

second stack height detecting means for detecting whether the height of a stack of sheets stacked on said first sheet stacking tray has reached a second height which is higher than the first height;

third stack height detecting means for detecting whether a height of a stack of sheets stacked on said second sheet stacking tray has reached a third height; and control means for controlling said image forming apparatus by judging states of the stack of sheets on said first sheet stacking tray and said second sheet stacking tray on the basis of results of detection provided by said first stack height detecting means, said second stack height detecting means and said third stack height detecting means, wherein said control means judges said first sheet stacking tray to be in a maximum stacked state when said second stack height detecting means has detected that the height of the stack of sheets stacked on said first sheet stacking tray has reached the second height and, after that, performs control to discharge sheets onto said second sheet stacking tray until said first stack height detecting means detects that the height of the stack of sheets stacked on said first sheet stacking tray has become less than the first height.

9. An image forming apparatus according to claim 8, further comprising conveying path change-over means for changing over a conveying path for conveying a sheet having an image formed thereon by said image forming means to one of a path leading to said first sheet discharging means and a path leading to said second sheet discharging means, wherein said control means performs control to cause said conveying path change-over means to change over the sheet conveying path from the path leading to said first sheet discharging means to the path leading to said second sheet discharging means, by judging said first sheet stacking tray to be in the maximum stacked state when said second stack height detecting means has detected that the height of the stack of sheets stacked on said first sheet stacking tray has reached the second height.

10. An image forming apparatus according to claim 8, wherein, when said first sheet stacking tray is judged to be in the maximum stacked state and said third stack height detecting means has detected that the height of the stack of sheets stacked on said second sheet stacking tray has reached the third height, said control means judges both said first sheet stacking tray and said second sheet stacking tray to be in a maximum stacked state and performs control to stop an image forming action of said image forming means.

11. An image forming apparatus according to claim 10, wherein, when the height of the stack of sheets stacked on said first sheet stacking tray has become less than the first height or when the height of the stack of sheets stacked on said second sheet stacking tray has become less than the third height, said control means performs control to resume the image forming action, which has been stopped, and to discharge sheets onto one of said first sheet stacking tray and said second sheet stacking tray, which has been released from the maximum stacked state.

12. An image forming apparatus according to claim 8, further comprising memory means for storing image information to be formed on a sheet by said image forming means, wherein, when said first sheet stacking tray is judged to be in the maximum stacked state and said third stack height detecting means has detected that the height of stack of sheets stacked on said second sheet stacking tray has reached the third height, said control means judges both said first sheet stacking tray and said second sheet stacking tray to be in a maximum stacked state and performs control to cause said memory means to store image information to be subsequently formed.

13. An image forming apparatus according to claim 12, wherein, when the height of the stack of sheets stacked on said first sheet stacking tray has become less than the first height after reaching the second height or when the height of the stack of sheets stacked on said second sheet stacking tray has become less than the third height after reaching the third height, said control means performs control to cause the image information stored in said memory means to be formed on a sheet and to discharge the sheet onto one of said first sheet stacking tray and said second sheet stacking tray, which has been released from the maximum stacked state.

14. An image forming apparatus according to claim 8, wherein, when the height of the stack of sheets stacked on said first sheet stacking tray has reached the second height and, after that, sheets are discharged onto said second sheet stacking tray, if the height of the stack of sheets stacked on said first sheet stacking tray has become less than the first height before the height of the stack of sheets stacked on said second sheet stacking tray reaches the third height, said control means performs control to discharge sheets onto said second sheet stacking tray until the height of the stack of sheets stacked on said second sheet stacking tray reaches the third height.

15. An image forming apparatus according to claim 8, wherein, when the height of the stack of sheets stacked on said first sheet stacking tray has reached the second height and, after that, sheets are discharged onto said second sheet stacking tray, if the height of the stack of sheets stacked on said first sheet stacking tray has become less than the first height before the height of the stack of sheets stacked on said second sheet stacking tray reaches the third height, said control means performs control to discharge sheets onto said second sheet stacking tray until a job in process of image forming by said image forming means ends.

16. An image forming apparatus according to claim 8, further comprising display means for displaying a state of the stack of sheets stacked on said first sheet stacking tray and a state of the stack of sheets stacked on said second sheet stacking tray on the basis of results of detection provided by said first stack height detecting means, said second stack height detecting means and said third stack height detecting means, wherein said control means performs control to cause said display means to make a display indicating that said first sheet stacking tray is in the maximum stacked state, by judging said first sheet stacking tray to be in the maximum stacked state when said second stack height detecting means has detected the height of the stack of sheets stacked on said first sheet stacking tray has reached the second height, and, after that, to cause said display means to continue making the display indicating that said first sheet stacking tray is in the maximum stacked state, until said first stack height detecting means detects that the height of the stack of sheets stacked on said first sheet stacking tray has become less than the first height, and wherein said control means performs control to cause said display means to make a display indicating that said second sheet stacking tray is in a maximum stacked state, when the height of stack of sheets stacked on said second sheet stacking tray has reached the third height.

17. An image forming apparatus according to claim 16, wherein said control means causes said display means to make a display indicating that said first sheet stacking tray is close to the maximum stacked state, when the height of the stack of sheets stacked on said first sheet stacking tray has reached the first height.

18. An image forming apparatus according to claim 16, wherein said control means causes said display means to make a display indicating that said first sheet stacking tray is close to the maximum stacked state, when the height of the stack of sheets stacked on said first sheet stacking tray has reached the first height, and, after that, causes said display means to make the display indicating that said first sheet stacking tray is in the maximum stacked state, when the height of the stack of sheets stacked on said first sheet stacking tray has reached the second height.

19. An image forming apparatus according to claim 8, further comprising presence-or-absence detecting means for detecting presence or absence of sheets stacked on said first sheet stacking tray, wherein said control means performs control to stop sheets from being discharged onto said first sheet stacking tray, when the height of stack of sheets stacked on said first sheet stacking tray has reached the second height, and, after that, to continue stopping sheets from being discharged onto said first sheet stacking tray, until disappearance of sheets from said first sheet stacking tray is detected by said presence-or-absence detecting means.

20. An image forming apparatus according to claim 8, wherein a different between the first height and the second height in the height of the stack of sheets stacked on said first sheet stacking tray is not less than 2 mm.

21. An image forming apparatus, comprising:

image forming means for forming an image on a sheet;

sheet discharging means for discharging a sheet having an image formed thereon by said image forming means;

a sheet stacking tray for stacking thereon sheets discharged from said sheet discharging means;

stack height detecting means for detecting whether a height of a stack of sheets stacked on said sheet stacking tray has reached each of a first height and a second height which is higher than the first height, the first height representing a state where the sheet stacking tray is close to a maximum stacked state and the second height represents a state where the sheet stacking tray is in the maximum stacked state; and display means for displaying a state of stack of sheets stacked on said sheet stacking tray on the basis of a result of detection provided by said stack height detecting means.

22. An image forming apparatus according to claim 21, wherein said display means makes a display indicating that said sheet stacking tray is close to a maximum stacked state, when said stack height detecting means has detected that the height of the stack of sheets stacked on said sheet stacking tray has reached the first height, and makes a display indicating that said sheet stacking tray is in the maximum stacked state, when said stack height detecting means has detected that the height of the stack of sheets stacked on said sheet stacking tray has reached the second height.

23. An image forming apparatus according to claim 22, wherein said display means turns off the display indicating that said sheet stacking tray is close to the maximum stacked state, in making the display indicating that said sheet stacking tray is in the maximum stacked state when the height of the stack of sheets stacked on said sheet stacking tray has reached the second height.

24. An image forming apparatus according to any one of claims 21 to 23, wherein said display means makes a display indicating that said sheet stacking tray is in a maximum stacked state, when said stack height detecting means has detected that the height of the stack of sheets stacked on said sheet stacking tray has reached the second height, and, after that, continues making the display indicating that said sheet stacking tray is in the maximum stacked state, until the height of stack of sheets stacked on said sheet stacking tray becomes less than the first height.

25. A sheet stacking system, comprising:

a sheet stacking apparatus comprising sheet discharging means for discharging a sheet, a sheet stacking tray for stacking thereon sheets discharged from said sheet discharging means, first stack height detecting means for detecting whether a height of a stack of sheets stacked on said sheet stacking tray has reached a first height, and second stack height detecting means for detecting whether the height of a stack of sheets stacked on said sheet stacking tray has reached a second height which is higher than the first height; and a control apparatus comprising control means for controlling said sheet stacking apparatus, said control means judging a state of the stack of sheets on said sheet stacking tray on the basis of results of detection provided by said first stack height detecting means and said second stack height detecting means, wherein said control means judges said sheet stacking tray to be in a maximum stacked state when said second stack height detecting means has detected that the height of stack of sheets stacked on said sheet stacking tray has reached the second height and, after that, continues judging said sheet stacking tray to be in the maximum stacked state until said first stack height detecting means detects that the height of the stack of sheets stacked on said sheet stacking tray has become less than the first height.

26. A sheet stacking system according to claim 25, wherein said sheet stacking apparatus and said control apparatus are connected to each other through a network.

27. A sheet discharging apparatus, comprising:

discharging means for discharging a sheet;

a tray for stacking thereon sheets discharged from said sheet discharging means;

first detecting means for detecting whether a height of sheets stacked on said tray has reached a first height;

second detecting means for detecting whether the height of sheets stacked on said tray has reached a second height which is higher than the first height; and display means for displaying the state of stack of sheets on said sheet stacking tray, wherein said display means displays that said tray is close to the maximum stacked state when said first detecting means has detected that the height of the sheets stacked on said tray has reached the first height, and, after that, said display means displays that said tray is in the maximum stacked state when said second detecting means has detected that the height of the sheets stacked on said tray has reached the second height.

28. A sheet discharging apparatus according to claim 27, wherein after said display means displays that said tray is in the maximum stacked state, said display means displays that said tray is in the maximum stacked state, until said first detecting means detects that the height of the sheets stacked on said tray has become less than the first height.

29. A sheet discharging apparatus, comprising:

a discharging means for discharging a sheet;

a tray for stacking thereon sheets discharged from said discharging means:

first detecting means for detecting whether a height of sheets stacked on said tray has reached a first height;

second detecting means for detecting whether the height of the sheets stacked on said tray has reached a second height which is higher than the first height;

control means for controlling said sheet discharging apparatus so that said discharging means stops to discharge sheet onto said tray when said second detecting means has detected that the height of the sheets stacked on said tray has reached the second height, and after that, said control means controls said discharging apparatus so that said discharging means does not discharge sheet onto said tray until said first detecting means detects that the height of the sheets stacked on said tray has become less than the first height.

30. A sheet discharging apparatus according to claim 29, wherein said control means controls said sheet discharging apparatus so that said discharging means is not allowed to discharge a sheet after said second detecting means has detected that the height of the sheets stacked on said tray has reached the second height until said first detecting means detects that the height of the sheets stacked on said tray has become less than the first height.

31. A sheet discharging apparatus according to claim 29, wherein after said second detecting means has detected that the height of the sheets stacked on said tray has reached the second height, said control means controls said discharging apparatus so that said discharging means is allowed to discharge a sheet when said first detecting means detects that the height of the sheets stacked on said tray has become less than the first height.

32. A sheet discharging apparatus, comprising:

a first discharging means and second discharging means each for discharging a sheet;

a first tray for stacking thereon sheets discharged from said first discharging means;

a second tray for stacking thereon sheets discharged from said second discharging means;

first detecting means for detecting whether a height of the sheets stacked on said first tray has reached a first height;

second detecting means for detecting whether the height of the sheets stacked on said first tray has reached a second height which is higher than the first height;

third detecting means for detecting whether a height of the sheets stacked on said second tray has reached a third height; and control means for controlling said sheet discharging apparatus, wherein said control means performs control to stop sheets from being discharged onto said first tray and performs control to discharge sheets onto said second stacking tray when said second detecting means has detected that the height of the stack of sheets stacked on said first sheet stacking tray has reached the second height.

33. A sheet discharging apparatus according to claim 32, wherein said control means controls said sheet discharging apparatus so that said first discharging means is not allowed to discharge a sheet after said second detecting means has detected that the height of the sheets stacked on said first tray has reached the second height until said first detecting means detects that the height of the sheets stacked on said first tray has become less than the first height.

34. A sheet discharging apparatus according to claim 32, wherein after said second detecting means has detected that the height of the sheets stacked on said first tray has reached the second height, said control means controls said sheet discharging apparatus so that said first discharging means is allowed to discharge a sheet when said first detecting means detects that the height of the sheets stacked on said first tray has become less than the first height.

35. A sheet discharging apparatus according to claim 32, wherein after said second detecting means has detected that the height of the sheets stacked on said first tray has reached the second height, said control means controls said sheet discharging apparatus so that said second discharging means stops to discharge a sheet when said third detecting means has detected that the height of the sheet stacked on said second tray has reached the third height.

* * * * *

UNITED STATES PATENT AND TRADEMARK OFFICE

CERTIFICATE OF CORRECTION

PATENT NO. : 6,408,147 B1
DATED : June 18, 2002
INVENTOR(S) : Haruhisa Oshida

It is certified that error appears in the above-identified patent and that said Letters Patent is hereby corrected as shown below:

Title page,
Item [57], ABSTRACT,
Line 9, "In" should be deleted.

Column 11,
Line 54, "present" should read -- presence --.

Column 17,
Line 33, "comprising" should read -- comprising: --.

Signed and Sealed this

First Day of October, 2002

*Attest:*

*Attesting Officer*

JAMES E. ROGAN
*Director of the United States Patent and Trademark Office*